United States Patent [19]

Thomas

[11] Patent Number: 4,792,025

[45] Date of Patent: Dec. 20, 1988

[54] CADDY LUGGAGE

[76] Inventor: Robert E. Thomas, 650 Floyd Ave., Chula Vista, Calif. 92010

[21] Appl. No.: 164,086

[22] Filed: Mar. 4, 1988

[51] Int. Cl.[4] ..... A45C 13/26; A45C 13/36; A45C 13/38; A45C 5/14

[52] U.S. Cl. ..... 190/18 A; 190/115; 190/37; 190/100

[58] Field of Search ..... 190/18 A, 18 R, 100, 190/37, 115

[56] References Cited

U.S. PATENT DOCUMENTS

| | | | |
|---|---|---|---|
| 2,925,283 | 2/1960 | Stilger | 190/18 A |
| 4,163,484 | 8/1979 | Delaney | 190/18 R |
| 4,261,447 | 4/1981 | Arias et al. | 190/18 A |
| 4,759,431 | 7/1988 | King et al. | 190/18 A |

FOREIGN PATENT DOCUMENTS

| | | | |
|---|---|---|---|
| 961977 | 11/1949 | France | 190/18 A |
| 59346 | 1/1954 | France | 190/18 A |
| 1494169 | 7/1967 | France | 190/18 A |
| 144998 | 8/1976 | United Kingdom | 190/18 A |
| 2030966 | 4/1980 | United Kingdom | 190/18 A |
| 2168035 | 6/1986 | United Kingdom | 190/18 A |

*Primary Examiner*—William Price
*Attorney, Agent, or Firm*—Charmasson & Holz

[57] ABSTRACT

A suitcase is modified to have wheels at the bottom corners of the rear face of the suitcase, a retractable handle with an offset to secure stacked luggage against the offset, and a spring actuated folding shelf which can grip adjacent luggage items. The offset handle can be used for normal lifting when retracted and pulling when extended. Offset allows extension structure to be placed in the rear wall of the suitcase while the handle is placed in the normal central location. The offset also lowers the center of gravity of the combination, especially when other items of luggage are stacked on the extensible handle. The shelf is incorporated into the front wall, and can be folded out and down to support adjacent luggage. The shelf is spring loaded towards the closed (flush with suitcase) position, in order to secure the shelf when not in use and to grip adjacent luggage when the shelf is deployed. Wheels are placed in recessed corners using a single bracket and axle component which provides added structural integrity with minimum added weight.

18 Claims, 3 Drawing Sheets

CADDY LUGGAGE

FIELD OF THE INVENTION

This invention relates to baggage, more specifically to wheeled luggage and extensible accessories.

BACKGROUND OF THE INVENTION

Luggage for the traveling public use should be small, light weight, pleasing in appearence and low in cost. However, at the same time, the luggage must have a high impact strength and a rugged construction, and be able to be stacked. Another desirable feature is the ability to be transportable together with the traveler's other bags and luggage. All this must be accomplished within the limitations in a harsh environment.

A common approach to these objectives is to provide wheels for the item of luggage. However, because the item of luggage was not originally designed for wheels, added structure must also typically be provided. In addition, another handle must also typically be added or existing handle modified to allow convenient pulling of the item of luggage.

A variety of luggage accessories and luggage modifications are known which incorporate wheels and handles to better accomplish these objectives. One type, illustrated in U.S. Pat. No. 2,042,387, employs wheels and folding handles to allow the traveler to pull rather than lift the luggage. Another related approach, ilustrated by U.S. Pat. No. 4,621,404, uses retractable handles and a molded body to improve wheel support and structural integrity. Another approach, illustrated by U.S. Pat. No. 4,314,624, directly provides structure between a new handle and wheels, along with recesses for wheels and handle.

Still another approach, as illustrated by U.S. Pat. Nos. 4,254,850 and 4,588,055, interconnects handle and wheel retraction mechanisms, allowing a single motion to deploy wheels and handle. U.S. Pat. No. 4,217,675 illustrates a spring/latch configuration method of deploying wheel and retracting/ retaining wheels in a recess when wheels are not in use. U.S. Pat. No. 2,439,660 illustrates a retractable wheel assembly for mounting on the corners of a sturdy trunk.

A different approach, illustrated in U.S. Pat. No. 4,087,102, incorporates a wheeled cart into an item of luggage. A further modification of this approach, as illustrated by U.S. Pat. No. 4,261,447, provides a wheeled cart frame attached to and incorporated into the luggage, including an extensible base member to allow other luggage to be loaded adjacent to, and pulled in conjunction with the modified item. A further extension of this approach is illustrated by U.S. Pat. No. 4,036,336, which also includes a luggage cart incorporated into a suitcase, but also provides a retractable handle which can support stacked luggage on top the specific modified item, as well as a shelf for adjacent items of luggage. Wheels for this collapsible trolley/-cart may be swung into position to increase clearance as well as the trolley cart being detachable, as shown in U.S. Pat. No. 3,960,252.

All of these previous devices and methods accomplish the intended purpose of making the luggage more easily transported by pulling and rolling, but all of these approaches have common shortcomings. These common shortcomings include:

A second handle is required to provide for the pulling the wheeled configuration (typically pulled in the direction parallel to the longest dimension or mounted on an extensible structure), in addition to a handle for normal lifting (typically lifted in the direction parallel to the second shortest dimension).

Stacked or adjacent luggage must be separately secured to extensions or shelves of the combination, or allowed to rest in place on the shelf/extension without securing, depending solely upon gravity and careful transport to maintain adjacent or stacked position.

Stacked and adjacent luggage raises the center of gravity of the combination and increases the load, making combination more likely to tip over and more difficult to control.

Although wheels, racks/shelves and handle extensions are retractable or placed into recesses, aesthetic qualities (clean lines) and appearance of these modifications have not been appealing, that is, they look more like a cart than luggage.

SUMMARY OF THE INVENTION

The principal and secondary objects of the invention are:

To provide an attractive piece of luggage that also performs as a wheeled cart;

To provide retractable/foldable extensions to the item which secures adjacent and stacked luggage without requiring a separate means of securing;

To provide an extension handle arrangement which reduces the center of gravity of the combination of luggage items and reduces the chance of tipping during pulling; and To provide a single handle for lifting or pulling the item or combination of luggage and wheeled caddy.

These and other objects are achieved by a suitcase having wheels at the bottom, a retractable handle with an offset and means to secure stacked luggage, and a biased folding shelf with means to grip additional luggage items. The offset handle can be used for normal lifting when retracted and for pulling when extended. The offset allows the extension structure to be placed in the sidewall of the suitcase while the handle is positioned in the normal central location. The offset also lowers the center of gravity of the combination, especially when other items of luggage are stacked on the extensible handle. A shelf incorporated into the other sidewall, can be folded out and down to support additional luggage. The shelf is biased towards the closed (flush with suitcase) position, in order to secure the shelf when not in use and to grip adjacent luggage when the shelf is deployed. The wheels are placed in recessed corners using a single bracket and axle component which provides added structural integrity at minimum added cost or weight.

DESCRIPTION OF THE PREFERRED EMBODIMENT

Figure 1:
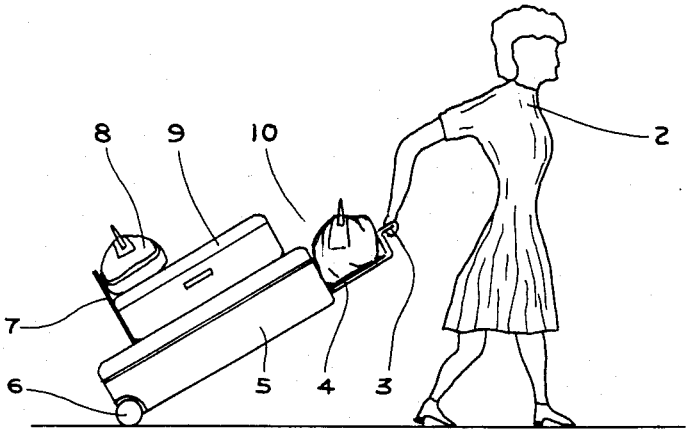
FIG. 1 shows a side view of a traveler pulling the caddy luggage with the handle extended and pulled by a traveler.

FIG. 1 shows a side view of a traveler pulling a caddy luggage with the handle extended. Traveler 2 is holding onto a handle or gripping member 3 attached to an extensible support member 4 extending from the case 5. Case 5 includes wheels 6 and a shelf 7 to allow the traveler 2 to pull not only the case 5 but luggage adjacent to case 5, specifically items 8 and 9, as well as items placed on top of case 5, specifically item 10. Offset handle 3 and extensible member 4 and wheels 6 allow the traveler 2 to easily pull the combined luggage items 5, 8, 9 and 10.

Figure 2:
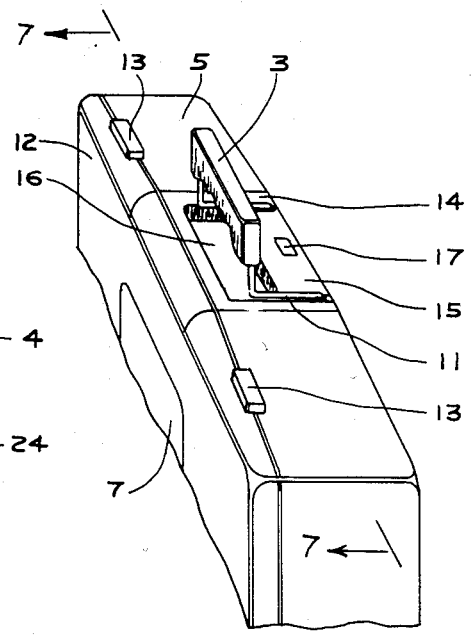
FIG. 2 shows a partial top perspective view of the caddy luggage with the handle retracted.

FIG. 2 shows a partial top perspective view of the caddy luggage with the handle retracted. Handle 3 is placed in the approximate center of the top face of case 5. Handle 3 is attached to the extensible structure (not shown for clarity) by offset structure 11. Offset structure 11 attaches handle 3 in the approximate center of the top of case 5 to the extensible structure 4 located proximate to the rear face of case 5. The front face of case 5 is hinged to allow opening and entry of personal effects of traveler 2 (not shown for clarity). The front face 12 is locked to the remainder of case 5 by two sets of locks 13. Top face of case 5, which is approximately a parallelepiped, is generally flat except for the middle portion 14 which is slightly raised to provide recesses 15 and 16. Recess 15 allows offset structure 11 to lie flush in the retracted position. Recess 16 allows space for traveler's hand to grip the handle 3. Retention control 17 controls the grasping of extension support 4 by a mechanism shown in FIG. 3 just underneath the top face of the case 5.

Figure 3:
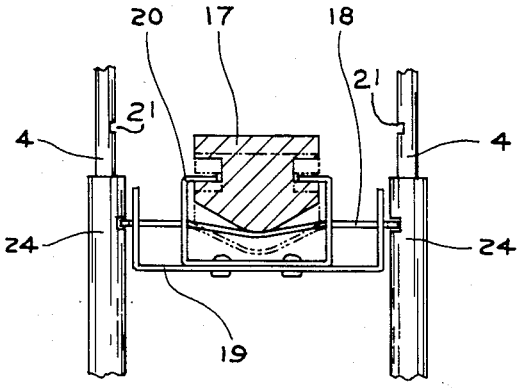
FIG. 3 shows a partial cross sectional view of extension structure retention control.

FIG. 3 shows a partial cross-section of extension structure retention control 17. Extension control button or switch 17 applies a deforming force to elastic spring element 18 mounted in support structure 19. The ends of spring element 18 contact depressions 21 in the extensible members 4. When control button 17 is depressed against buttom bracket 20, the spring element is deformed (shown dotted for clarity), pulling the ends out of depressions 21 allowing the extensible structure to be extended. An alternative would be for a continuous roughened surface in place of depressions 21 also allowing element 18 ends to grasp and retain extension 4.

Figure 4:
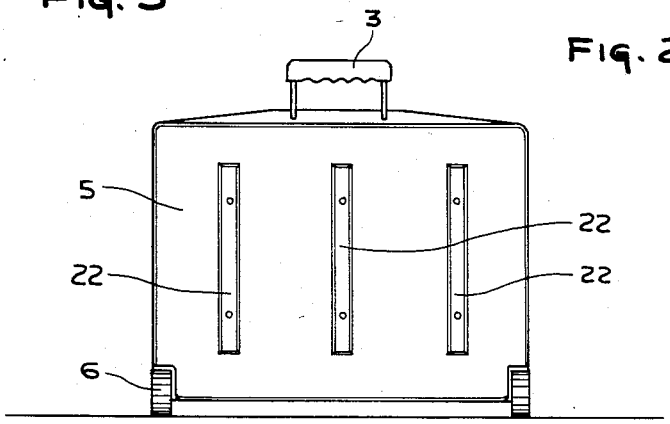
FIG. 4 shows a back view of the caddy luggage.

FIG. 4 shows a back view of a caddy luggage item. The rear face of case 5 has rubber strips 22 to increase resistance to sliding when case is resting on the back face. Handle 3 protrudes from the top of case 5 in a centralized position. Wheels 6 are located at the corners of the bottom of case 5 slightly protruding from the normal structure of case 5. An alternative configuration would have retractable wheels.

Figure 5:
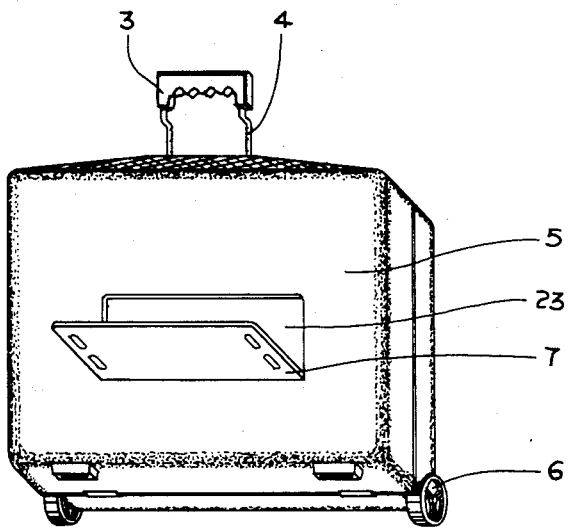
FIG. 5 shows a front perspective view of a caddy luggage with a shelf partially opened.

FIG. 5 shows a front perspective view of a caddy luggage with the shelf partially open. Location of shelf 7 can be varied from an open shelf flush to the ground for carrying adjacent large items and minimizing the need to lift these large items, to smaller shelves located higher on the front face of case 5 to minimize bending for smaller items. Wheels 6 are again on the bottom portion of case 5 proximate to the rear face of case 5. Handle 3 is on the top of case 5 near the approximate center of the top of case 5. Shelf 7 is hinged to the front face of case 5 and when fully retracted is placed in recess 23 located on the front face of case 25. The hinge is located toward the bottom of the front face of case 5 and allows shelf 7 to deploy upward and towards the front face of case 5. This motion tends to grasp smaller items of luggage placed on shelf 7.

Figure 6:
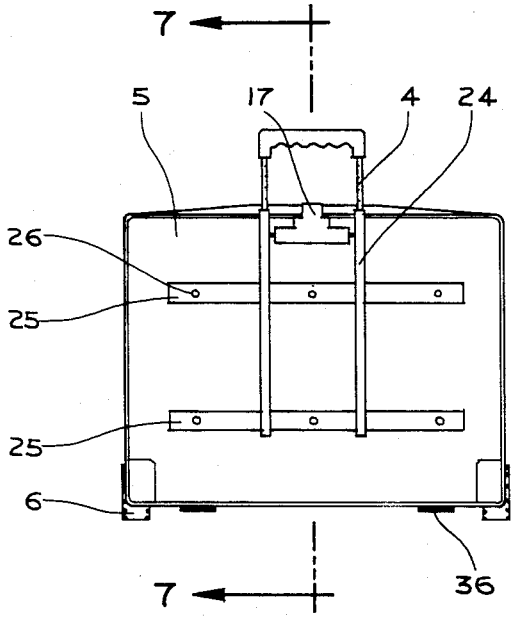
FIG. 6 shows a cross sectional view of caddy luggage with the handle partially extended.

FIG. 6 shows a cross-sectional view of caddy luggage with the handle partially extended. The view is from just inside the rear face of case 5 as shown in FIG. 2. Extensible structure 4 is placed in tubes 24 which are attached to brackets 25 which are in turn attached to the rear face of case 5. Threaded screws 26 can be used to attach brackets 25 to the rear face of case 5 as well as attach rubber strips 22 to the outward portion of the rear face of case 5 (rubber strips not shown for clarity in this view). Extension structure 4 is slidably attached to tubes 24 allowing a rigid structure when retention control 17 secures the extension member.

Figure 7:
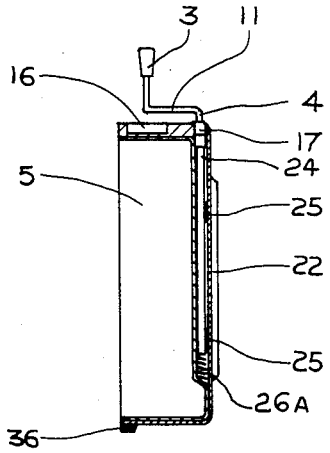
FIG. 7 shows a side cross sectional view of caddy luggage.

FIG. 7 shows a side cross-sectional view of caddy luggage. Extensible structure 4 is shown partially extended from tubes 24 which are secured by brackets 25 to the rear face of case 5 and abrasion bumpers or rubber strips 22. Offset structure 11 is attached to extension member 4 allowing handle 3 to be placed in the approximate center of the top face of case 5. Offset member 11 also provides a mechanism for retaining luggage (not shown in this view) between offset member 11 and the top face of case 5. In an alternative configuration brackets 25 can be extended to the edges of case 5 to provide additional structure and rigidity as well as additional support and structure for wheels 6 (not shown in this view for clarity). In another embodiment, the extensible structure 4 may be biased closed, forcing offset 11 against case 5 by springs 26A mounted at the bottom of tubes 24, or forcing offset 11 against luggage placed on top of case or container 5. This spring simplifies the traveler's efforts upon loading and unloading the caddy luggage. Control 17 is released, handle is pulled out and control 17 released, additional luggage is loaded on top of the caddy luggage and control 17 is released again bringing offset in contact with luggage by spring action until control 17 locks the extensible structure in place holding the added luggage. Location of handle 3 is not required to be exactly in the center of the top of case 5, only to be conviently located for both pulling and lifting. This location is generally directly over the item's center of gravity for lifting and above the center of gravity for pulling.

Figure 8:
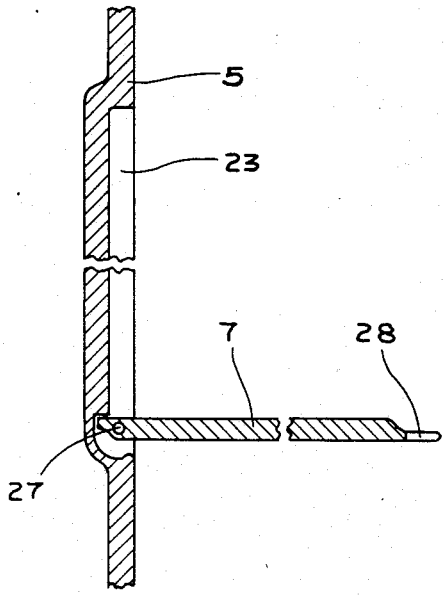
FIG. 8 shows a partial side cross sectional view of caddy luggage shelf in the open position.

FIG. 8 shows a partial side cross-sectional view of caddy luggage shelf in the open position. Shelf 7 is shown fully open from the front face of case 5. Recess 23 is provided in the front face of case 5 to allow a flush appearance of case 5 when shelf 7 is fully retracted. Shelf 7 is hinge supported to the front face of case 5 by hinge 27. Interior surface 29 of the shelf 7 can be roughened to grip adjoining luggage. Lip 28 is provided to assist in opening shelf 7 from recess 23.

Figure 9:
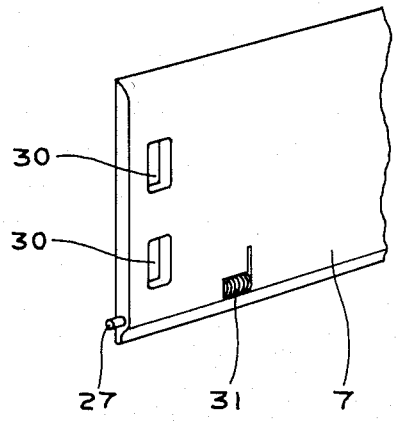
FIG. 9 shows a partial perspective view of a shelf.

FIG. 9 shows a partial perspective view of a shelf. Shelf 7 contains cutouts 30 to allow additional and external means to secure adjoining luggage. Spring 31 is placed around hinge 27 to bias the shelf toward the closed position, that is towards recess 23. Spring 31 also tends to bring roughened surface 29 (not shown in this view for clarity) in contact with adjoining luggage, retaining that luggage adjacent to case 5.

Figure 10:
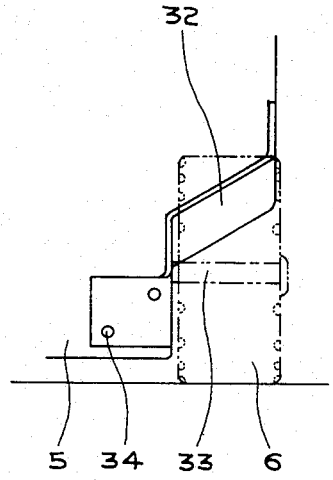
FIG. 10 shows a partial back view of a wheel and bracket assembly of a caddy luggage.

FIG. 10 shows a partial back view of a wheel and bracket assembly of a caddy luggage item. Bracket 32 is attached to the recessed corners of case 5 to provide a rigid mounting for axle 33 upon which is mounted wheel 6. One piece construction of bracket 32 allows a rigid structure which withstands loads in several directions and provides structural rigidity for wheel 6 mounted on axle 33. Rivets 34 are used to attach bracket 32 to case 5.

Figure 11:
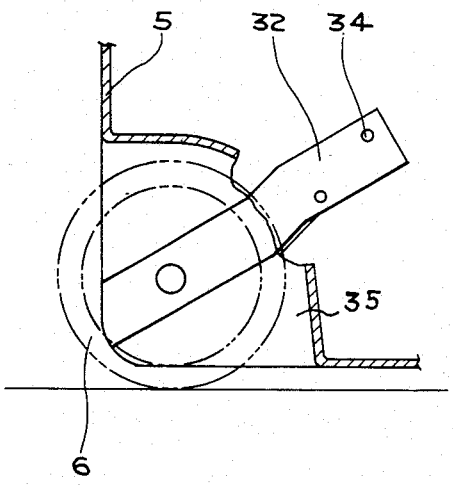
FIG. 11 shows a partial front view of a wheel and bracket assembly of a caddy luggage.

FIG. 11 shows a partial front view of a wheel and bracket assembly of caddy luggage. Wheel 6 is located on the bottom portions of case 5 supported by axle 33 which is attached to bracket 32. Bracket 32 is attached to case 5 using rivets 34. Corner recess 35 of case 5 allows placement of wheel 6 in an unobtrusive but still functional location, allowing wheels to rotate when case 5 is pulled by handle 3 (not shown in this view for clarity). If the aesthetic qualities require, wheels can be further retracted into recesses 35 or an additional structure to hide wheels 6 can be provided in alternative configurations.

While the preferred and some alternative embodiments of the invention has been shown and described, changes and modifications may be made therein within the scope of the appended claims without departing from the spirit and scope of this invention.

What is claimed is:

1. A luggage and caddy combination for containing items of personnal property of a traveler and for carrying other pieces of luggage, which comprises:

a generally parallelipipedic container defined by opposite first and second faces, first and second opposite sides, a top and a bottom;

rolling means for rotatively supporting said container, said rolling means being attached to said container about a first axis parallel and proximate to the intersection of said first face and bottom;

a generally planar shelf having one edge rotatively secured to said second face about a second axis parallel and proximate to the intersection of said bottom and second face, said shelf being movable from a stowed position generally parallel to said second face to at least one deployed position generally orthogonal with said second face;

a support structure having one end secured to said container, an opposite second end shaped and dimensioned to form a handle at a first location near the top of the container, and an extensible section between said first and second end, said section having means for extending said second end to at least one other location above and apart from said top along a plane generally parallel and proximate to the plane of said first face; and means for locking said support structure in each of said locations.

2. The combination claimed in claim 1 wherein :

said support structure is secured against the inside of said first face;

said opposite second end protrudes outside said container from an area proximate to the middle of the intersection of the top and first face, and includes a first segment running from said area in a generally parallel direction to top to a median location equidistant from said first and second face, and a second segment attached to said first segment and forming said handle.

3. The combination as claimed in cliam 2 which also comprises means for said first segment to grasp other items of said personal property placed proximate to said top face of said container.

4. The combination as claimed in claim 3 wherein said first segment is also shaped and dimensioned to locate said second segment directly over the approximate center of gravity of said container when said traveler lifts said container.

5. The combination as claimed in claim 4 wherein said first segment is also shaped and dimensioned to locate said second segment above said container's center of gravity when said traveler is pulling said container.

6. The combination as claimed in claim 3 wherein said rolling means comprises:

two brackets attached to said container;

two axles attached to said brackets, having an axis parallel to said second segment's largest dimension; and two wheels rotatably mounted on said axles.

7. The combination as claimed in claim 1 wherein said second segment consists of a projecting structure from said support structure.

8. The combination as claimed in claim 2 wherein said means for locking consists of a deformable element attached to said top face of said container, having an end retractably contacting depressions in said extensible structure.

9. The combination as claimed in claim 8 which also comprises a recess in said second face of said container into which said shelf is capable of folding into.

10. The combination as claimed in claim 9 which also comprises a shelf biasing means attached to said shelf, tending to force said shelf into said recess.

11. The combination as claimed in claim 10 which also comprises a handle biasing means attached to said extensible structure, tending to force said handle proximate to said top of said container.

12. The combination as claimed in claim 11 which also comprises an offset recess in said top face of said container shaped and dimensioned to receive said offset structure.

13. The combination as claimed in claim 12 which also comprises a handle recess in said top face of said container shaped and dimensioned to receive said handle and hand of said traveler

14. The combination as claimed in claim 10 wherein said foldable shelf is hinged connected to said second face of said container and said biasing means consists of a coiled spring attached to said shelf and coiled around said hinge.

15. The combination as claimed in claim 11 wherein said handle biasing means consists of an extensible spring attached to said extensible structure and said container.

16. The combination as claimed in claim 2 which also comprises abrasion bumpers attached to said first face of said container.

17. The combination as claimed in claim 8 which also comprises a control button attached to said top face of said container, having a protrusion which is shaped and dimensioned to deform said deformable element sufficiently to remove said end from contact with said depressions in said extensible structure.

18. The combination as claimed in claim 17 wherein said depressions consist of a series of serrations on the extensible structure in contact with said deformable element end.

* * * * *